United States Patent [19]

Mosher

[11] 4,082,583

[45] Apr. 4, 1978

[54] SOLVENTLESS DOUBLE BASE PROPELLANTS AND METHOD FOR PLASTICIZING MTN NITROCELLULOSE PROPELLANTS WITHOUT USE OF SOLVENTS

[75] Inventor: Paul R. Mosher, Indian Head, Md.

[73] Assignee: The United States of America as represented by the Secretary of the Navy, Washington, D.C.

[21] Appl. No.: 435,391

[22] Filed: Jan. 14, 1974

[51] Int. Cl.[2] ..... C06B 25/18

[52] U.S. Cl. ..... 149/96; 149/100; 149/109.6

[58] Field of Search ..... 149/96, 100, 109.6

[56] References Cited

U.S. PATENT DOCUMENTS

| | | | |
|---|---|---|---|
| 3,447,983 | 6/1969 | Camp et al. | 149/96 X |
| 3,639,183 | 2/1972 | Crescenzo et al. | 149/96 X |
| 3,689,331 | 9/1972 | Pierce | 149/96 X |
| 3,732,131 | 5/1973 | Haurg et al. | 149/92 X |
| 3,844,856 | 10/1974 | Flynn et al. | 149/96 X |
| 3,855,373 | 12/1974 | Swotinsky et al. | 149/100 X |
| 3,867,214 | 2/1975 | Zucker et al. | 149/96 X |

*Primary Examiner*—Edward A. Miller
*Attorney, Agent, or Firm*—R. S. Sciascia; A. L. Branning; H. B. Field

[57] ABSTRACT

Solventless double base propellants plasticized by metriol trinitrate through the addition of triethylene glycol dinitrate in a ratio of at least 1:14 triethylene glycol dinitrate to metriol trinitrate.

6 Claims, No Drawings

SOLVENTLESS DOUBLE BASE PROPELLANTS AND METHOD FOR PLASTICIZING MTN NITROCELLULOSE PROPELLANTS WITHOUT USE OF SOLVENTS

BACKGROUND OF THE INVENTION

This invention relates generally to propellant compositions and more particularly to solventless double base propellants having an energetic plasticizer with no secondary nitroxy groups.

Double base propellants are homogenous propellants having a binder e.g. nitrocellulose and an energetic plasticizer. The use of these propellants in gun, missile or gas generating auxiliary equipment is known in the art. This type of propellant has many advantages over single base propellants. For example, single base propellants have a greater variance in performance. This is due to their having been manufactured by a solvent process and retaining a varying amount of residual volatile solvent. A solvent process is needed to manufacture a single base propellant. As the amount of solvent is increased, an objectionably long drying cycle becomes required by the solvent process, and the amount of retained residual solvent also increases. However the adoption of solventless double base propellants for gun and auxiliary equipment uses has been slight due mainly to a lack of an alternative energetic plasticizer to nitroglycerin.

Although nitroglycerin is extremely energetic and has a good plasticizing capacity, the many disadvantages of this nitrate ester discourages its use. First of all, nitroglycerin is extremely hazardous. The sensitivity and high energy make nitroglycerin dangerous to handle and makes the resulting propellant composition more sensitive to unwanted detonation. Also nitroglycerin is volatile and the resulting vapors cause sickness and headaches to humans, thereby causing health problems in the manufacture, handling, and storage of any composition containing nitroglycerin.

The sensitivity of nitroglycerin also causes the propellant composition to have a high hazard classification which means extra expense for storage, and a more limited reserve. Another disadvantage is exudation. Nitroglycerin has a tendency to migrate out of the composition, and thereby result in poorer firing accuracy due to variance in propellant strength.

Flame temperatures of a propellant containing nitroglycerin are high. This characteristic necessitates the addition of coolants which produce soot and smoke in the exhaust. If coolants are not used, the high burning temperature excessively erodes the barrel in comparison with single-base powders.

In applications requiring a high degree of mechanical strength e.g. most missile and many gun propellant uses, the solvent process is used to make the double base propellants. However, difficulties are encountered in the process itself and in the end product. The solvent process requires a lengthy drying cycle and a final blending. During the solvent process, volatiles are introduced into the propellant composition. Volatiles shorten the shelf life of a propellant. With nitroglycerin propellants, a serious problem is compounded in that compositions containing nitroglycerin have already a poor shelf life as compared to single base propellants.

Since the beginning of World War II much effort has been expended to find an alternative plasticizer to nitroglycerin and a way of avoiding the necessity of a solvent manufacturing process for most gun propellants. Unfortunately the resulting compositions had poor performance or poor mechanical strength or had to rely excessively on solvents in order to process the propellant.

Nitrate esters like polyolpolynitrates have excellent energy content. But upon contact with ordinary nitrocellulose, only the outer layers of the nitrocellulose softened. No plasticizing of the nitrocellulose takes place, which is essential for any propellant composition. Other nitrate esters are good plasticizers but have low energy and have many of the drawbacks of nitroglycerin, such as poor stability, high sensitivity, as well as being hazardous to the health of humans.

Some attempts have been made to combine various nitrate esters together or with nitroglycerin. These attempts resulted in a propellant with low energy levels or poor mechanical strength. The method of preparation required the use of solvents or of an expensive preprocessed nitrocellulose or other binder. Since the preprocessing involved solvents, the resulting propellant had many of the drawbacks of a propellant prepared by a solvent process.

SUMMARY OF THE INVENTION

Accordingly, an object of this invention is to provide a double base propellant prepared by a solventless process having superior strength and performance.

Another object of this invention is to provide a superior double base propellant containing no nitroglycerin.

Still another object of this invention is to provide a double base propellant having a long shelf life.

A further object of this invention is to provide a double base propellant with improved stability.

Another object of this invention is to provide a double base propellant with improved performance consistency.

Another object of this invention is to provide a double base propellant having lower flame temperature.

Also an object of this invention is to provide a double base gun propellant which can be formulated with a wide range of mass impetus and particularly with a mass impetus above that of the nitrocellulose-nitroglycerin propellants.

Also another object of this invention is to provide a double base propellant with reduced flash and visible flame.

Still another object of this invention is to provide a double base propellant having a low and controlled level of volatiles, which are not organic in nature.

And another object of this invention is to provide a double base propellant having a plasticizer which does not migrate.

Yet another object of this invention is to provide a double base propellant causing fewer health hazards in its preparation, handling and storage.

These and other objects are attained by increasing the plasticizing proficiency of metriol trinitrate through the addition of triethylene glycol dinitrate to such a degree that any grade of nitrocellulose or similar binder may form a double base propellant with metriol nitrate without the use of solvents in the preparation.

DESCRIPTION OF THE PREFERRED EMBODIMENTS

Double base propellants include a binder and an energetic plasticizer. This basic composition is usually supplemented with a number of additives. The use of a mixture of metriol trinitrate and triethylene glycol dinitrate as an energetic plasticizer does not restrict the choice of these other art recognized ingregients.

While preferably the nitrocellulose used herein is a water wet soluble grade (12.6%N), other types of nitrocellulose with a nitrogen content as low as 12.0% N or as high as 13.5%N may be used. The nitrocellulose may constitute from about 30 to about 70 weight percent of the total composition. Preferably the nitrocellulose would constitute from about 40 to about 60 weight percent with the most preferred range being from about 45 to about 50 weight percent.

Examples of suitable stabilizers which may be used are 2-nitrodiphenylamine (2NDPA), ethyl centralite (EC), and N-methyl paranitroanilines. The preferred stabilizer is ethyl centralite. The stabilizer may constitute from about 0.5 to about 5 weight percent of the total composition weight with about 1 to about 4 weight percent preferred and about 1 to about 2 weight percent the most preferred.

If it is desired to use a nonenergetic plasticizer in addition to the energetic one, such art recognized plasticizers as di-n-propyl adipate, triacetin, di-isobutyl azelate, metriol triacetate, and dibutylphthylate, mixtures thereof, and the like may be used. Usually the amount would be between about 0.5 to about 9.0 weight percent.

A flash pressant may be added such as crylolite in an amount from 0.5 to 3 weight percent.

If a particular formulation is causing a coppering problem, a lead salt, e.g. lead $\beta$-resorcylate may be added as a decoppering agent.

Other additives which may advantageously be incorporated in a propellant formulation encompassed by the present invention include candelilla wax which in minute quantities facilitates extrusion.

The new plasticizer of this invention for solventless double base propellants is a mixture of metriol trinitrate (MTN) in an amount from about 30 to about 60 weight percent with about 25 to about 50 weight percent preferred and from about 39 to about 42 weight percent the most preferred, and triethylene glycol dinitrate (TEGDN) in an amount from about 2 to about 20 weight percent with about 3 to about 11 weight percent preferred and two ranges of from about 3 to about 4 and from about 9 to about 11 weight percent the most preferred.

Increasing the amount of MTN relative to TEGDN diminishes the plasticization of nitrocellulose, increases the energy content of the propellant composition, increases the flame temperature, and diminishes the flash. The most preferred ratios of MTN to TEGDN are 13:1 and about 4:1. The 13:1 ratio gives a propellant with a high energy content and a flame temperature comparable to single base propellants of similar energy content if a non energetic plasticizer is included. It should be noted that the non-energetic plasticizer is added more to minimize the flame temperature than to increase the plasticization of nitrocellulose. The MTN/TEGDN energetic plasticizer is capable of plasticizing nitrocellulose up to a ratio of 15:1.

One of the major advantages of this invention is that it may be prepared by almost any process and particularly a propellant of exceptional strength can be obtained from the solventless process. Accordingly the solventless process is the preferred method of preparation. A basic solventless method of preparation would include the following steps. The nitrocellulose is mixed to a thin slurry in about 10 times its weight of warm water. A solution of the desired additives is admixed with the slurry. A solution of metriol trinitrate and triethylene glycol dinitrate is slowly added to the slurry. Thereafter, the slurry is filtered or centrifuged to remove most of the water and the resulting paste is aged for a period of 1 to 5 days or more at a temperature of about 130° F. At this point it has a moisture level of from 8 to 15 percent and the mixture is milled to a homogenous colloid on a heated differential rolling mill, followed by a heated even speed mill. The method of mixing is not critical, provided that distribution of all ingredients is uniform and no losses of ingredients occur which are not otherwise accounted for. The sheet propellant formed may be extruded into any desired form.

The general nature of the invention having been set forth, the following examples are presented as specific illustrations thereof. It is understood that the invention is not limited to these examples but is susceptible to different modifications that would be recognized by one of ordinary skill in the art.

TABLE I

| Ingredient | Ex. 1 | Ex. 2 | Ex. 3 |
|---|---|---|---|
| Nitrocellulose (12.6%) | 46.0 | 34.9 | 53.0 |
| metriol trinitrate | 38.5 | 46.0 | 41.9 |
| triethylene glycol dinitrate | 3.0 | 15.0 | 4.0 |
| ethyl centralite | 2.0 | 1.0 | 1.0 |
| basic lead carbonate | 1.0 | — | — |
| potassium sulfate | 1.0 | 1.0 | — |
| dibutyl phthalate | 8.4 | — | — |
| polyethylene | — | 2.0 | — |
| candelilla wax | 0.1 | 0.1 | 0.1 |

The above examples were tested for a number of physical and thermodynamic properties and the results are summarized in the next table.

TABLE 2

| Test | Ex. 1 | Ex. 2 | Ex. 3 |
|---|---|---|---|
| Impetus, in-lb/lb | 3.56 $\times 10^6$ | 4.3 $\times 10^6$ | 4.4 $\times 10^6$ |
| Flame Temp., ° K | 2260 | 2790 | 3130 |
| Moles of Gas/100 gun of prop | 4.76 | 4.61 | 4.25 |
| Heat of Explosion, cal/gm | 750 | 800 | 998 |

Several sample formulations were made with different explosive plasticizer ratios or a new inert plasticizer. These compositions are given in TABLE 3. Again these samples were prepared by the solventless method described previously. After the manufacture of the rolled sheet stock, each composition was extruded through a 0.250 - inch - diameter die as a solid rod. These rods were then used for testing.

The method used for performing tensile property was the one developed by Picatinny Arsenal. The strands were cut to a length of 6 inches. Next the ends were potted with mixture of 65% Epon 828 and 75% Versamid 125 to create handles for use in pulling the strands. Table 4 contain the results of the tensile tests.

TABLE 3

| Composition (%) | Ex. 1 | Ex. 4 | Ex. 5 | Ex. 6 |
|---|---|---|---|---|
| Nitrocellulose (12.0% N) | 46.0 | 46.0 | 46.0 | 46.5 |
| Metriol trinitrate | 38.5 | 38.5 | 38.5 | 30.0 |
| Triethylene glycol dinitrate | 3.0 | 3.0 | 3.0 | 15.0 |
| Ethyl centralite | 2.0 | 2.0 | 2.0 | 2.0 |
| Potassium sulfate | 1.0 | 1.0 | 1.0 | 1.0 |
| Basic lead carbonate | 1.0 | 1.0 | 1.0 | 1.0 |
| Dibutyl phthalate | 8.4 | — | — | — |
| Di-isobutyl azelate | — | 8.4 | — | — |
| Di-normal-propyl adipate | — | — | 8.4 | 4.4 |

TABLE 3-continued

| Composition (%) | Ex. 1 | Ex. 4 | Ex. 5 | Ex. 6 |
|---|---|---|---|---|
| Candelilla wax | 0.1 | 0.1 | 0.1 | 0.1 |
| Total | 100.0 | 100.0 | 100.0 | 100.0 |

TABLE 4

| | Test temperature | | | |
|---|---|---|---|---|
| | 77° F | | 40° F | |
| Composition | Tensile strength at failure (psi) | Elongation (%) | Tensile strength at failure (psi) | Elongation %) |
| Ex 1 | 905 | 20.0 | 8120 | 7.8 |
| Ex 4 | 810 | 19.0 | 7250 | 6.6 |
| Ex 5 | 687 | 21.9 | 5210 | 5.0 |
| Ex 6 | 592 | 22.0 | 7610 | 7.4 |

A gun propellant in wide use in this country and in the western world comprises 91 weight percent of nitrocellulose (12.0%N), 1 weight percent of ethyl centralite, 3 weight percent of butyl stearate, 1 weight percent of basic lead carbonate, 1 weight percent of potassium sulfate and 3 weight percent of total volatiles. In the Navy it is referred to as NACO. This particular formulation provides a gun propellant which is cool, clean burning, and not needing soot-producing coolants. The following table shows a comparison of NACO with example composition 1.

TABLE 5

| | NACO | Ex 1 |
|---|---|---|
| Flame temperature, $T_v$ | 2200° K | 2260° K |
| HOE (cal/g) | 752 | 750 |
| Impetus (in-lb/lb) | $3.2 \times 10^6$ | $3.56 \times 10^6$ |
| RQ (NACO is reference) | 100 | 98 |
| RF (NACO is reference) | 100 | 106 |
| Density (lb/in$^3$) | 0.057 | 0.054 |
| Moles gas/100g | 4.32 | 4.76 |
| Initial velocity variability (ft/sec) | 10.9 | 5.5 |
| Dispersion at 18,000 yards (%) | 0.59 | 0.48 |

From these tables it can be seen that a propellant system and process have been developed which can produce high quality propellants for a wide range of force levels. It is of particular interest that more uniform initial velocities are obtained. Further these propellants are prepared by a process requiring no lengthy drying cycle and no final blending normally associated with the manufacture of double base propellants.

Obviously many modifications and variations of the present invention are possible in light of the above teachings. It is therefore to be understood that, within the scope of the appended claims, the invention may be practiced otherwise than as specifically described.

What is claimed as new and desired to be secured by Letters Patent of the United States is:

1. A metriol trinitrate plasticized double-base propellant having about 30 to about 70 weight percent nitrocellulose, an energetic plasticizer consisting of about 30 to 60 weight percent metriol trinitrate and about 2 to 20 weight percent triethylene glycol dinitrate which is prepared by the solventless process wherein the process includes slurrying any grade of nitrocellulose with warm water, adding to said slurry the desired additives, filtering or centrifuging said slurry so as to form a paste, aging said paste and milling said aged paste on a heated rolling mill so as to form a homogenous colloided propellant.

2. The propellant of claim 1 wherein metriol nitrate constitutes from about 35 to about 50 weight percent of the total composition and triethylene glycol dinitrate constitutes from about 3 to about 11 weight percent of the total composition.

3. The propellant of claim 1 wherein metriol nitrate constitutes from about 39 to about 42 weight percent and triethylene glycol dinitrate constitutes from about 9 to about 11 weight percent of the total composition.

4. A process for preparing high strength solventless propellants which comprises, preparing a propellant composition by the solventless process wherein said process includes slurrying nitrocellulose with warm water, adding to said slurry the desired additives, filtering or centrifuging said slurry so as to form a paste, aging said paste and milling said aged paste on a heated rolling mill so as to obtain a homogenous colloided propellant, wherein the improvement comprises:

mixing triethylene glycol dinitrate with metriol trinitrate in a ratio of at least 1:15;

adding said mixture of triethylene glycol dinitrate and metriol trinitrate to said slurry of double base ingredients; and plasticizing any grade of nitrocullose with said metriol trinitrate.

5. The process of claim 4 wherein the ratio of triethylene glycol dinitrate to metriol trinitrate is about 1:4.

6. The process of claim 4 wherein the ratio of triethylene glycol dinitrate to metriol trinitrate is about 1:13.

* * * * *